US007604498B2

(12) United States Patent
Mahajan

(10) Patent No.: US 7,604,498 B2
(45) Date of Patent: Oct. 20, 2009

(54) INSULATION-DISPLACEMENT CONNECTOR

(76) Inventor: Kamal Mahajan, 22 Ducharme La., Greenlawn, NY (US) 11740-1611

( * ) Notice: Subject to any disclaimer, the term of this patent is extended or adjusted under 35 U.S.C. 154(b) by 0 days.

(21) Appl. No.: 11/903,828

(22) Filed: Sep. 24, 2007

(65) Prior Publication Data

US 2008/0081507 A1 Apr. 3, 2008

Related U.S. Application Data

(60) Provisional application No. 60/846,567, filed on Sep. 22, 2006.

(51) Int. Cl.
*H01R 11/20* (2006.01)

(52) U.S. Cl. ..... 439/410; 439/425; 174/71 R

(58) Field of Classification Search ..... 439/410, 439/422, 425–426; 174/71 R
See application file for complete search history.

(56) References Cited

U.S. PATENT DOCUMENTS 4,201,436 A * 5/1980 Genovese et al. ..... 439/48
5,338,220 A * 8/1994 Soes et al. ..... 439/403
5,435,747 A * 7/1995 Franckx et al. ..... 439/409
2007/0249204 A1 * 10/2007 Petersen et al. ..... 439/208

* cited by examiner

*Primary Examiner*—Edwin A. Leon
*Assistant Examiner*—Vanessa Girardi
(74) *Attorney, Agent, or Firm*—Carter, DeLuca, Farrell & Schmidt, LLP

(57) ABSTRACT

An insulation-displacement connector includes a base member defining first and second sides. The first side is configured to guide and secure a first cable in a first direction and the second side is configured to guide a second cable in a second direction substantially perpendicular to the first direction. The first and second pins each having first and second ends disposed through the base member. The first ends of the pins being configured to pierce the first cable and mechanically and electrically engage internally disposed conductors in the first cable and the second ends being configured to pierce the second cable and mechanically and electrically engage internally disposed conductors in the second cable. First and second covers are pivotably disposed on the base member. The first cover is positionable to mechanically force the first cable into engagement with the first ends of the first and second pins and the second cover is positionable to mechanically force the second cable into engagement with the second ends of the first and second pins.

1 Claim, 4 Drawing Sheets

INSULATION-DISPLACEMENT CONNECTOR

PRIORITY CLAIM TO PROVISIONAL APPLICATION

This patent application claims priority to and the benefit of U.S. Provisional Patent Application No. 60/846,567 filed in the U.S. Patent and Trademark Office on Sep. 22, 2006, entitled "Wire Snap Housing".

BACKGROUND

1. Technical Field

The present disclosure relates to wire connectors, and in particular, to a snap-on insulation-displacement connector with perpendicular wire guides to allow perpendicular connection of two cable.

2. Description of Related Art

Wire connectors are devices that can connect one wire to another wire. These wire connectors are also referred to as wire interconnects. Sometimes the wire connector is designed to connect a grouping of wires to another grouping of wires, e.g., such as the wires found in a ribbon cable. A ribbon cable (also known as multi-wire planar cable) is a cable that includes a plurality of conducting wires running parallel to each other on the same flat plane. Thus, the cable appears wide and flat as contrasted to bundled cables that appear round. Its name comes from the resemblance of the cable to a piece of ribbon (which is likewise wide and flat).

Each wire includes a conductive core that is formed from an elongated strand of drawn cylindrical metal (or metallic material) or a grouping of the strands. The strands are covered with various insulating materials, such as plastic or rubber-like polymers that provide mechanical strength, prevent corrosion, prevent electrical shorts, and provide thermal insulation. The strands may also be wrapped concentrically and further protected with substances like paraffin, preservative compounds, bitumen, lead sheathing, steel taping, or the like. These protected wires may be glued or thermally fused together to form a ribbon cable.

One way of connecting two wires together is to "splice" them together. For splicing two wires together, the protective layers of both wires must be removed and the metallic strands of the two wires must be mechanically and electrically connected together. A wire stripper can be used to remove the protective covering. After the protective layers are removed, the strands can be fused together using heat, can be soldered together using a soldering iron and solder, or otherwise can be mechanically connected together (e.g., using screw terminals).

Another way of connecting two wires together is to use metal pins capable of piercing the protective layers of the wires forming the electrical connection. These types of connectors are commonly referred to as insulation-displacement connectors and may include one or more pins designed to pierce through the protective layer of one wire, touching the conductive core therein, to provide a conductive path to the conductive core of another wire.

Insulation-displacement connectors can include a row of pins with a wire guide ensuring that the wires are properly positioned. The wire may be secured by crimping. A crimper, and/or other type of securing device can push the pins through one or more wires while permanently (or temporarily) securing the wires. Some insulation-displacement devices have a row of male connector pins that can be inserted into a corresponding grouping of female connector pins to form the cable connection. Other insulation-displacement connectors directly connect the cables together to form the wire interconnect.

SUMMARY

The present disclosure relates to wire connectors, and in particular, to a snap-on insulation-displacement connector designed to splice cables in a perpendicular manner.

An insulation-displacement connector includes a base member defining first and second sides. The first side is configured to guide and secure a first cable in a first direction and the second side is configured to guide a second cable in a second direction substantially perpendicular to the first direction. The first and second pins each having first and second ends disposed through the base member. The first ends of the pins being configured to pierce the first cable and mechanically and electrically engage internally disposed conductors in the first cable and the second ends being configured to pierce the second cable and mechanically and electrically engage internally disposed conductors in the second cable. First and second covers are pivotably disposed on the base member. The first cover is positionable to mechanically force the first cable into engagement with the first ends of the first and second pins and the second cover is positionable to mechanically force the second cable into engagement with the second ends of the first and second pins.

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1A:
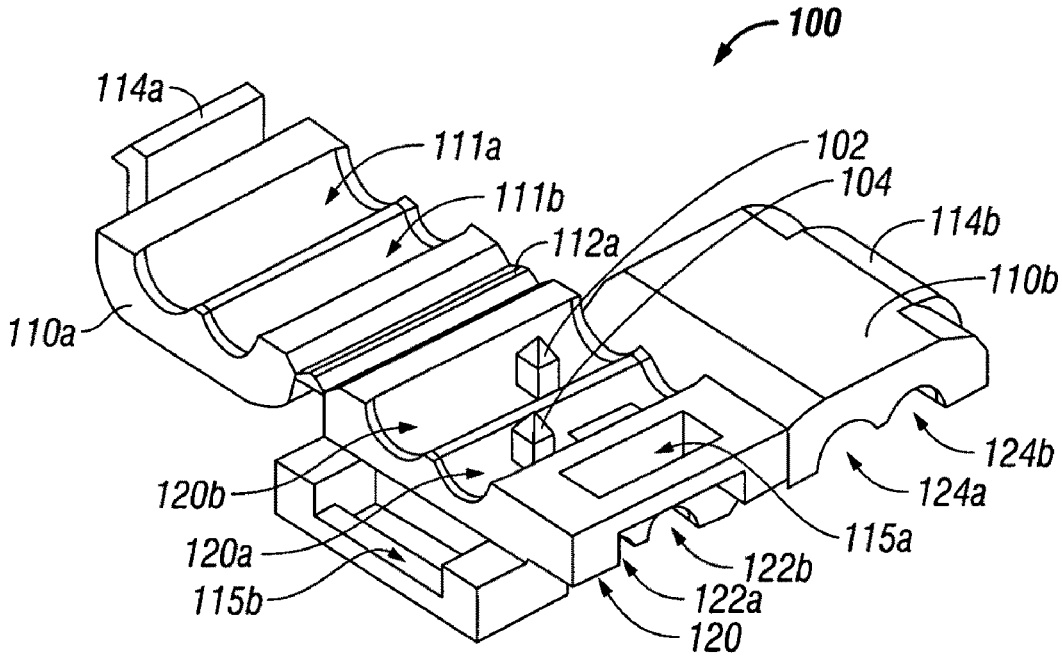
FIGS. 1A and 1B show views of an insulation-displacement connector with perpendicular wire guides that includes two pins for piercing a pair of two-wire ribbon cables in accordance with the present disclosure.
Figure 1B:
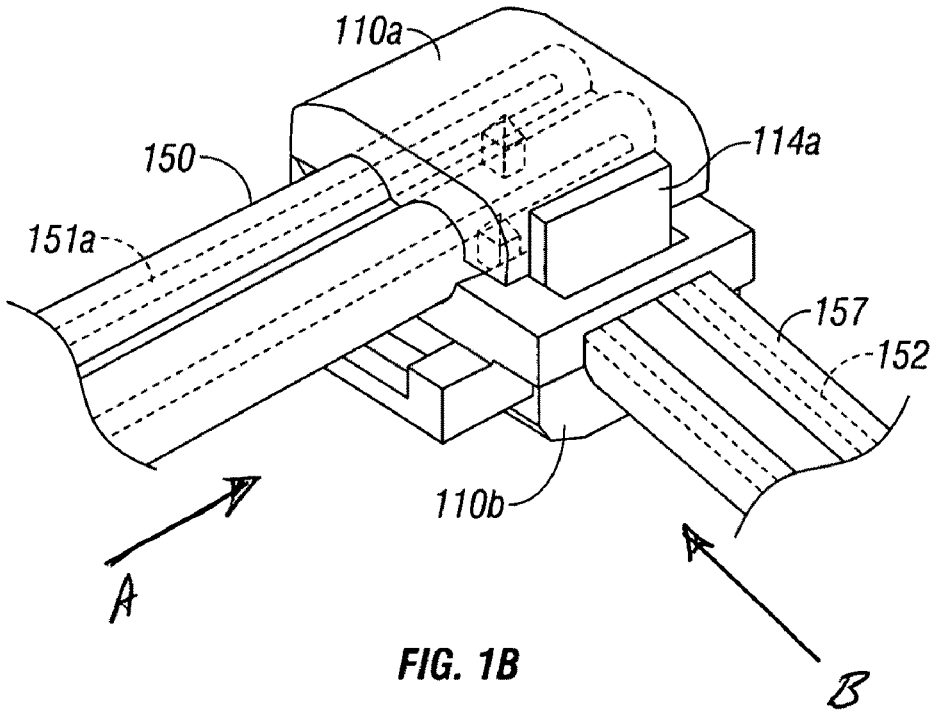

Referring to the drawings, FIGS. 1A and 1B show an insulation-displacement connector 100 (the phrase "insulation-displacement connector" is herein abbreviated as "IDC"). FIG. 1A is a perspective view of two-wire IDC 100 shown in an open configuration and FIG. 1B is view of the IDC 100 shown with one cable engaged therein and another junction cable engaged with the IDC connector 100.

IDC 100 includes pins 102 and 104 disposed through or integrally associated with a base 120 which is configured to support the splice connection as explained in more detail below. Pins 102 and 104 have a greater length than the thickest portion of base 120 to assure adequate electrical connection as described in more detail below. A pair of wire guides 120*a* and 120*b* are defined in base 120 and dimensioned to guide a two-wire cable 150 (see FIG. 1B) for subsequent piercing by pins 102 and 104, respectively, as explained in more detail below.

The IDC connector 100 also includes a wire cover 110*a* which is pivotable about a living hinge 112*a* from a first position which facilitates loading a first two-ribbon cable 150 into mechanical and electrical connection with the IDC connector 100 to a second position which establishes secure electrical contact with IDC connector 100. A second cover 110*b* is disposed perpendicular to cover 110*a* and, likewise, is moveable about a hinge 112*b* from a first position which facilitates loading a second two-wire cable 152 within IDC connector 100 to a second position which established electrical connection with cable 150 through the IDC connector 100 as explained in more detail below.

Figure 1C:
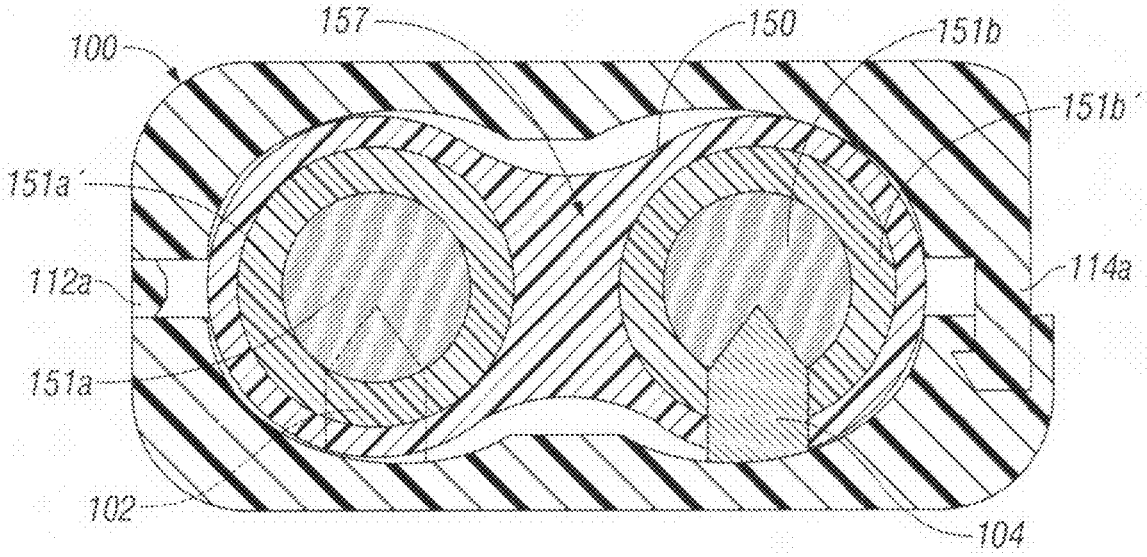
FIG. 1C is a schematically-illustrated view taken along line 1C-1C of FIG. 1A.

More particularly, two-wire cable 150 includes two internal conductors 151*a* and 151*b* which are surrounded by individually wrapped insulation 151*a*' and 151*b*', respectively (See FIG. 1C). Wire 150 also includes a separation contour 157 defined along the center thereof which allows separation of the two conductors 151*a* and 151*b* as needed for certain electrical applications such as an electrical tie-in or termination to electrical appliances.

In use, the IDC connector 100 facilitates perpendicular splicing of two (2) two-wire electrical cables for adding electrical connections along a standard electrical loop consistent with must commercial and residential applications. In other words, a user simply orients a first two-wire electrical cable, e.g., 150, in the direction of arrow "A" as shown in FIG. 1B and then orients a second two-wire cable 152 perpendicular to wire 150 (in the direction of arrow "B") and snaps on the IDC connector 100 to make to the splice. It is important to note that the two-wire cable 150 may be a continuous cable disposed in a standard electrical loop and is not necessarily a butt ended cable or terminated end (although it is feasible to utilize the present disclosure with these types of connections as well).

More particularly and with particular respect to FIG. 1B, wire 150 is oriented in the direction of arrow "A" and placed into IDC connector 100 such that wire connectors 151*a* and 151*b* are aligned in general vertical registration with wire guides 120*a* and 120*b*, respectively. Once oriented, IDC connector cover 110*a* is moved towards the second position (See FIG. 1B) to secure cable 150 within base 120. Corresponding wire guides 111*a* and 111*b* are formed in cover 110*a* to facilitate alignment and engagement of the cable 150 once secured. Some additional force is necessary to snap and secure the cover 110*a* atop base 120. Moreover, a flange 114*a* is included with cover 110*a* which is configured to secure the cover 110*a* to base 120 by virtue of mating mechanical engagement in a corresponding slot 115*a* defined therein. The additional force also causes pins 102 and 104 to pierce the outer jacket of cable 150 and insulation 151*a*' and 151*b*' to mechanically and electrically engage conductors 151*a* and 151*b*, respectively (See FIG. 1C).

In a similar manner, cable 152 may be oriented and engaged with the underside of base 120 in the direction of arrow "B". More particularly, cable 152 is positioned within wire guides 122*a* and 122*b* defined in the underside of base 120 such that internally disposed conductors 153*a* and 153*b* align for mechanical and electrical engagement with pins 102 and 104, respectively. Cover 110*b* is pivoted about hinge 112*b* in a similar manner as described above to force pins 102 and 104 through the outer jacket of cable 152 for mechanical and electrical engagement with conductors 153*a* and 153*b*. The cover 110*b* is secured atop base 120 by virtue of the mating engagement of flange 114*b* within slot 115*b* defined in base 120. Corresponding wire guides 124*a* and 124*b* are formed in cover 110*b* to facilitate alignment and engagement of the cable 152 once secured.

As can be appreciated, pin 102 provides electrical continuity between the internally dispose conductors 151*a* and 153*a* of cables 150 and 152, respectively, and pin 104 provides electrical continuity between the internally dispose conductors 151*b* and 153*b*. This allows a user to quickly and easily connect one or more electrical branches on an electrical loop without having to physically splice, twist and cap electrical connectors at an electrical junction. It is envisioned that the IDC connector 100 may include other insulative elements or surfaces to make the electrical connection water tight, e.g., rubber gaskets, seals, liquid insulators or self-hardening resins and the like.

Pins 102 and 104 are staggered along the length of the corresponding guide channels 120*a* and 120*b* (i.e., along base 120) to provide higher breakdown voltages between a pair of secured two-wire ribbon cables 150 and 152. The pin placements and relative distances between the staggered pins 102 and 104 are preferably configured to account for the dimension of standard ribbon cables. Moreover, three-wire or four-wire cables may also be connected in a similar fashion using three-wire or four-wire IDC connectors, 200 and 300, respectively.

Figure 2:
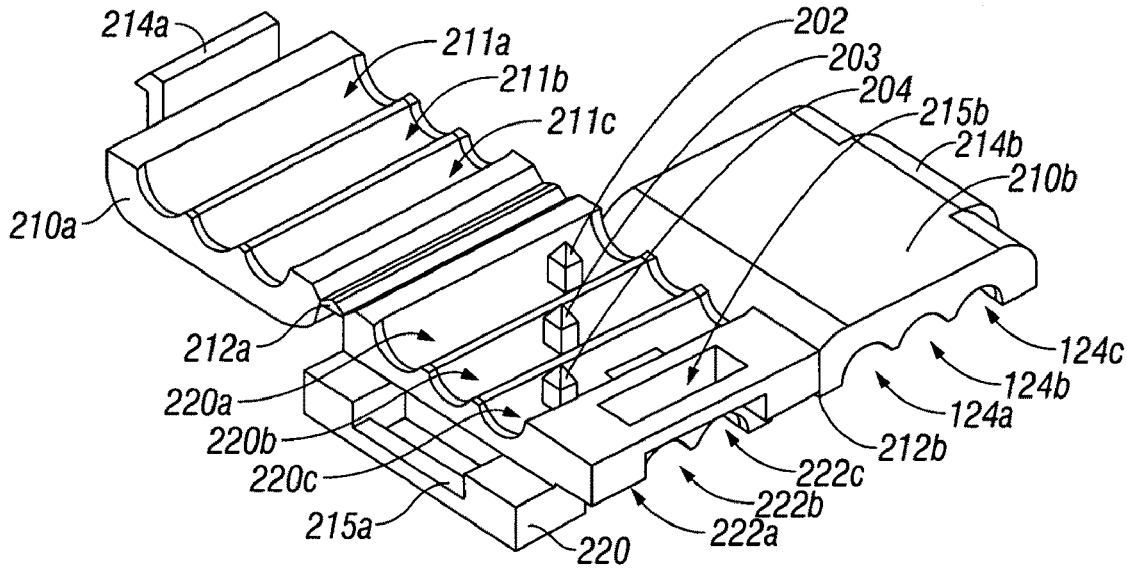
FIG. 2 shows an insulation-displacement connector with perpendicular wire guides that includes three pins for piercing a pair of three-wire ribbon cables in accordance with the present disclosure.

For example and as shown in FIG. 2, a three-wire IDC connector 200 may be utilized to splice two (2) three-wire ribbon cables (not shown) to form an electrical junction therebetween. The three-wire IDC connector 200 may be employed along a three-wire electrical loop or at a terminal end in a similar fashion as described above with respect to the two-wire ribbon cable 100. More particularly, the IDC connector 200 includes a series of three pins 202, 203 and 204 which are typically disposed through and staggered within corresponding wire guides 220*a*, 220*b* and 220*c* defined in one side of base 220, respectively. The wire guides 220*a*, 220*b* and 220*c* align a first cable (not shown) with pins 202, 203 and 204. Much like the above-described two-wire IDC connector 100, the underside of base 220 also includes wire guides 222*a*, 222*b*, 222*c* which align the internal conductors (not shown) of a second three-ribbon cable (not shown). Covers 210*a* and 210*b* snap (usually sequentially snapped) atop base 220 to secure the first and second three-wire cables in a similar fashion as described above with respect to FIGS. 1A-1C and flanges 214*a* and 214*b* engage slots 215*a* and 215*b* defined in base 220 to secure the IDC 200 to the three-wire cables to make the junction connection.

Much like the pins 102 and 104 mentioned above with respect to FIGS. 1A-1C, pins 202, 203 and 204 are sequentially staggered relative to base 220 (i.e., along two axes). This staggering provides higher breakdown voltages between the three-wire ribbon cables (not shown). The pin 202, 203 and 204 placements and relative distances between the staggered pins 202, 203 and 204 are preferably configured to account for the dimension of standard three-wire ribbon cables.

Figure 3:
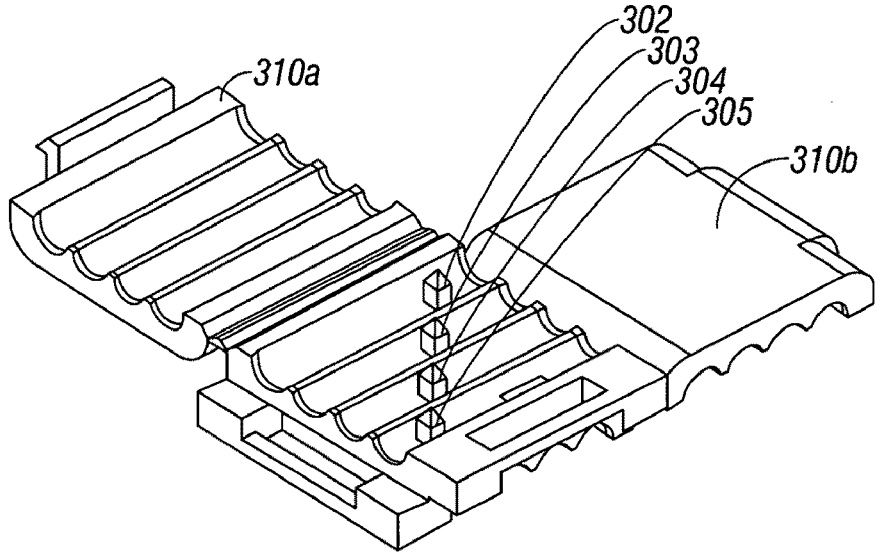
FIG. 3 show an insulation-displacement connector with perpendicular wire guides that includes four pins for piercing a pair of four-wire ribbon cables in accordance with the present disclosure.
Figure 4:
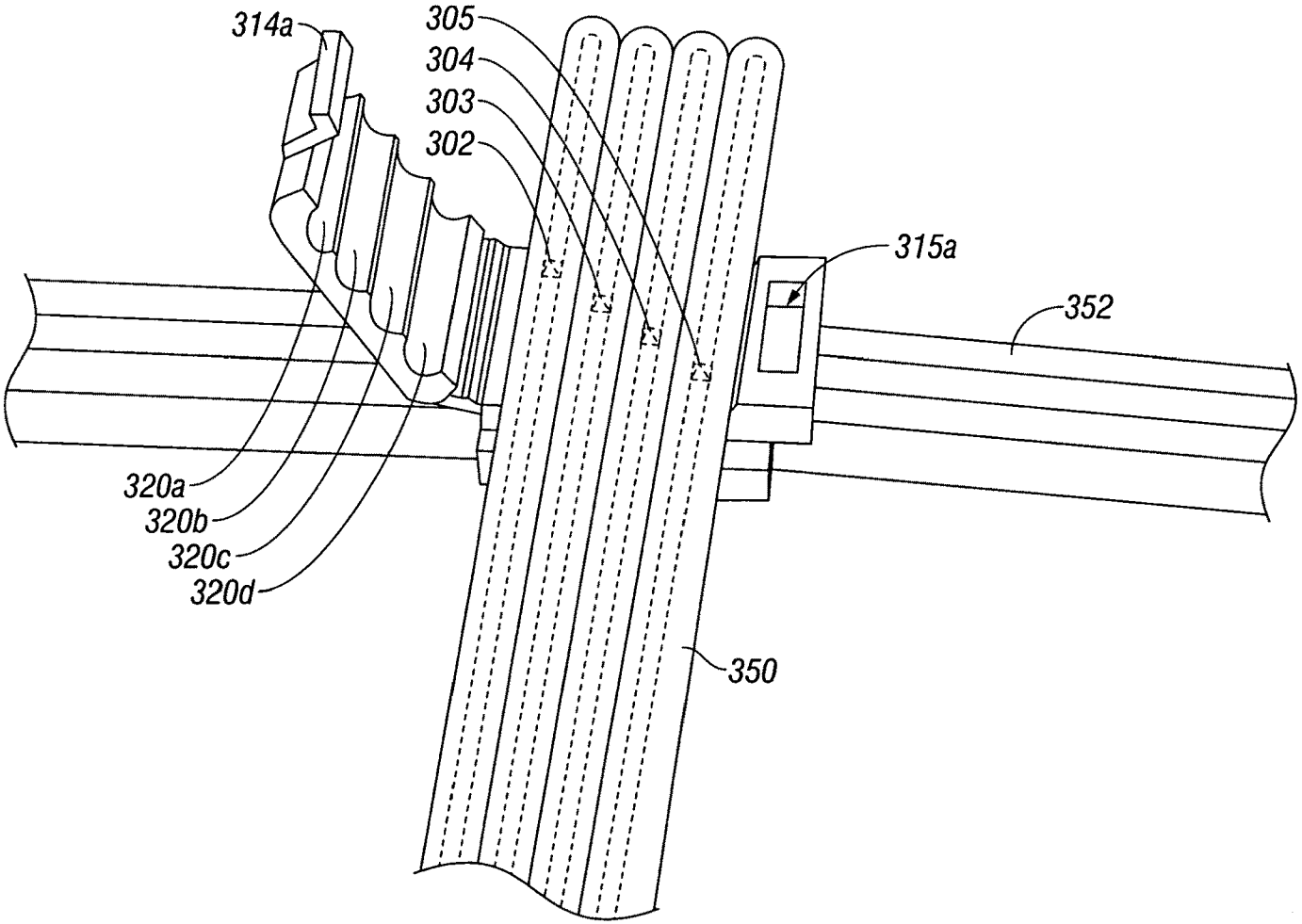
FIG. 4 is a perspective schematic view of the insulation-displacement connector of FIG. 3 with a secured four-wire ribbon cable electrically connected to another unsecured four-wire ribbon cable in accordance with the present disclosure.

FIGS. 3 and 4 show a similar IDC connector 300 for use with splicing four-ribbon cables 350 and 352 and IDC connector 300 includes similar elements as described above which perform similar functions, namely, base 320 having pins 302, 303, 304 and 305 defined therethrough, covers 310*a* and 310*b* for securing four-wire cables 350 and 352 to base 320. Much like above, wires guides 320*a*-320*d* and snap latches 314*a* (other snap latch not shown) align and secure the IDC connector 300 to the two cables 350 and 352 to complete the splice. Referring to FIG. 4, the IDC 300 is shown operatively connecting two four-wire ribbon cables 350 and 352.

It is envisioned that pins 102, 104, 202, 203, 204, 302, 303, 304 and 305 (hereinafter collectively referred to as "pins 102") are metallic and may be formed from one or more metals including aluminum, copper, gold iron, nickel, platinum, silver, steel, zinc, and the like. Additionally, the pins 102 may have a capacity of at least one ampere of electric current.

IDC 300 may be particularly used to conductively connect two SPT-3 cables together. "SPT" is an acronym for "service parallel thermoplastic". The "3" refers to the 1/16" Insulation of each respective wire. SPT cables are also referred to as "zip cords". An SPT-3 cable includes four wires fused together. Each of the four wires has multi-strands of metal in the core, usually comprised of copper, and is commonly used in professional residential landscape lighting. The four strand SPT-3 cables used with IDC 300 typically have an American Wire Gauge (AWG) value of 16 (making it a 16AWG×4C cable) and a temperature rating of about 105 degrees Celsius. The AWG value is a number designating the aggregate diameter of the conductive portion of a wire. Therefore, different AWG values have different current carry capacities. Especially for direct current applications (and/or low frequency applications), the diameter of the conductive portion of a wire determines the impedance per unit distance, and thus, the maximum rated current capacity of the wire.

IDCs 100, 200, and 300 (see FIGS. 1A through 4) may be used as a power bus tapping connector. For example, a cable may be a power bus used for residential landscape lighting, such as a cable buried along a residential sidewalk. For example, IDC 300 (See FIG. 4) may be utilized to connect to the power bus and carry current to a device, such as a sidewalk light.

IDCs 100, 200, and 300 may be manufactured by an injection molding process using thermoplastic and/or thermosetting plastic materials. Some of the materials that can be used with an injection molding process are polystyrene, acrylonitrile butadiene styrene, nylon, polypropylene, polyethylene, and polyvinyl chloride, or the like.

It is also envisioned that the IDC connectors (in particular IDC connectors 200 and 300) may be utilized with two cables having a different number of conductors depending upon a particular purpose. For example, a ribbon cable may be configured to include two lead cables, a neutral and a ground. A splice (or junction) may be made with an IDC connector (not shown) which contains only two pins but is engageable atop a four-wire ribbon cable (e.g., cable 350). The corresponding pins would be designed to engage only one lead and the neutral conductors inside the four ribbon cable to supply to a particular electrical appliance (e.g., light) at a junction. It is envisioned that the cables may have to have some kind of indicia disposed thereon to orient the electrician to coordinate proper splicing of particular conductors.

Moreover, it is envisioned that the wire guides or IDC connectors may be formed or molded to allow similar connections of cables at various angles of orientations, for example, from about 15 degrees to about 165 degrees depending upon a particular purpose. In this instance it may be necessary to reorient the pins, guide channels or internal molds of the base of the IDC connector to accomplish this purpose. It may also be necessary to split the cable along contour 57 to make this type of connection.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. An insulation-displacement connector, comprising:

a base member defining first and second sides, wherein the first side is configured to guide and secure a first cable in a first direction and the second side is configured to guide a second cable in a second direction substantially perpendicular to the first direction;

at least a pair of pins integrally formed with the base member and each having first and second ends disposed through the base member, the first ends of the pins being configured to pierce the first cable and mechanically and electrically engage internally disposed conductors in the first cable and the second ends being configured to pierce the second cable and mechanically and electrically engage internally disposed conductors in the second cable; and first and second covers pivotably disposed to the base member, the first cover being positionable to mechanically force the first cable into engagement with the first ends of the pins and the second cover being positionable to mechanically force the second cable into engagement with the second ends of the pins.

* * * * *